US010813512B2

(12) United States Patent
Cho et al.

(10) Patent No.: US 10,813,512 B2
(45) Date of Patent: Oct. 27, 2020

(54) CYCLONE DUST COLLECTOR AND VACUUM CLEANER HAVING THE SAME

(71) Applicant: Samsung Electronics Co., Ltd, Gyeonggi-do (KR)

(72) Inventors: Dong-jin Cho, Gyeonggi-do (KR); Hyeon-woo Tak, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/396,193

(22) Filed: Dec. 30, 2016

(65) Prior Publication Data

US 2017/0188769 A1 Jul. 6, 2017

(30) Foreign Application Priority Data

Dec. 30, 2015 (KR) ..... 10-2015-0190308

(51) Int. Cl.

| | |
|---|---|
| ***A47L 9/00*** | (2006.01) |
| ***A47L 9/16*** | (2006.01) |
| ***A47L 5/36*** | (2006.01) |
| ***A47L 9/12*** | (2006.01) |
| ***B04C 5/081*** | (2006.01) |

(Continued)

(52) U.S. Cl.

CPC ..... *A47L 9/1683* (2013.01); *A47L 5/36* (2013.01); *A47L 9/12* (2013.01); *A47L 9/1608* (2013.01); *A47L 9/1666* (2013.01); *A47L 9/1675* (2013.01); *A47L 9/1691* (2013.01); *B04C 5/081* (2013.01); *B04C 5/187* (2013.01); *B04C 9/00* (2013.01); *B04C 2009/004* (2013.01); *B04C 2009/007* (2013.01)

(58) Field of Classification Search

CPC ..... A47L 9/1683; A47L 9/12; A47L 9/1608; A47L 9/1666; A47L 9/1691; A47L 5/36; B04C 5/081; B04C 5/187; B04C 9/00; B04C 2009/004; B04C 2009/007

USPC ..... 15/300.1–422.2; 55/282–305

See application file for complete search history.

(56) References Cited

U.S. PATENT DOCUMENTS

| | | | |
|---|---|---|---|
| 1,420,665 | A | 6/1922 | Newcombe |
| 7,845,046 | B2 | 12/2010 | Milligan et al. |

(Continued)

FOREIGN PATENT DOCUMENTS

| | | | |
|---|---|---|---|
| CN | 101822506 | A | 9/2010 |
| EP | 1523916 | A2 | 4/2005 |

(Continued)

OTHER PUBLICATIONS

ISA/KR, "International Search Report," Application No. PCT/KR2016/015470, dated Apr. 13, 2017, Korean Intellectual Property Office, Daejeon, Korea, 3 pages.

(Continued)

*Primary Examiner* — T. Bennett McKenzie

(57) ABSTRACT

A cyclone dust collector having improved usability and a vacuum cleaner having the same are provided. The cyclone dust collector includes: a cyclone chamber including an inlet through which air is drawn in and an outlet through which dust-filtered air is discharged; a discharge passage disposed inside the cyclone chamber; a spiral part formed around the discharge passage to be inclined in a spiral pattern; and a grill rotatably disposed on the discharge passage, and the outlet is formed inside the discharge passage.

16 Claims, 19 Drawing Sheets

(51) Int. Cl.
*B04C 5/187* (2006.01)
*B04C 9/00* (2006.01)

(56) References Cited

U.S. PATENT DOCUMENTS

| | | | | |
|---|---|---|---|---|
| 8,549,704 | B2 | 10/2013 | Milligan et al. | |
| 2004/0098827 | A1* | 5/2004 | Oh | A47L 9/1675 15/347 |
| 2005/0081321 | A1 | 4/2005 | Milligan et al. | |
| 2006/0137302 | A1 | 6/2006 | Min | |
| 2008/0282894 | A1* | 11/2008 | Makarov | A47L 5/365 96/371 |
| 2009/0144931 | A1 | 6/2009 | Milligan et al. | |
| 2009/0313783 | A1 | 12/2009 | Nakano et al. | |
| 2011/0030164 | A1 | 2/2011 | Milligan et al. | |
| 2014/0366311 | A1* | 12/2014 | Han | A47L 9/16 15/339 |

FOREIGN PATENT DOCUMENTS

| | | | |
|---|---|---|---|
| JP | 2000342493 | | 12/2000 |
| JP | 2003010503 | | 1/2003 |
| JP | 4902703 | B2 | 3/2012 |
| KR | 20010049141 | A * | 6/2001 |
| KR | 20010049141 | A | 6/2001 |
| KR | 20030094874 | A | 12/2003 |
| KR | 101534981 | B1 | 7/2015 |
| WO | 2009139556 | A2 | 11/2009 |

OTHER PUBLICATIONS

ISA/KR, "Written Opinion of the International Searching Authority," Application No. PCT/KR2016/015470, dated Apr. 13, 2017, Korean Intellectual Property Office, Daejeon, Korea, 7 pages.

Supplementary European Search Report dated Sep. 4, 2018 in connection with European Patent Application No. 16 88 2111, 9 pages.

Communication pursuant to Article 94(3) EPC dated May 16, 2019 in connection with European Patent Application No. 16 882 111.4, 5 pages.

The First Office Action in connection with Chinese Application No. 2020031901736280 dated Mar. 24, 2020, 17 pages.

Communication under Rule 71(3) EPC in connection with European Application No. 16882111.4 dated Jun. 18, 2020, 14 pages.

* cited by examiner

CYCLONE DUST COLLECTOR AND VACUUM CLEANER HAVING THE SAME

CROSS-REFERENCE TO RELATED APPLICATION(S) AND CLAIM OF PRIORITY

The present application is related to and claims priority from Korean Patent Application No. 10-2015-0190308, filed on Dec. 30, 2015, in the Korean Intellectual Property Office, the disclosure of which is incorporated herein by reference in its entirety.

TECHNICAL FIELD

Apparatuses and methods consistent with exemplary embodiments relate to a cyclone dust collector having enhanced usability and a vacuum cleaner having the same.

BACKGROUND

A vacuum cleaner is a device that performs a cleaning operation by drawing in air using a suction force generated by a fan and a motor and filtering foreign substances contained in the drawn-in air.

The vacuum cleaner includes a dust collection unit disposed therein to filter foreign substances in the drawn-in air using a predetermined filtering device. The filing device disposed in the dust collection unit to filter foreign substances includes a porous filter unit which forcedly filters foreign substances by letting air pass through a porous filter, and a cyclone dust collection unit which filters foreign substances during a cyclone movement of air.

A cyclone dust collector may include an inlet through which air is drawn in and an outlet through which air is discharged. The air drawn in through the inlet is separated from foreign substances and discharged to the outside through the outlet.

The outlet may be provided with a grill. The grill has air passing holes to prevent foreign substances of a predetermined size or more from being discharged through the outlet. Large dust may be attached to the outer surface of the grill or hair may be curled around the grill by whirling air in the cyclone dust collector.

When the dust attached to the outer surface of the grill or hair clog the air passing holes, the suction force of the vacuum cleaner may be reduced. In addition, a user may experience the inconvenience of having to directly remove dust attached to the outer surface of the grill with user's hand.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

To address the above-discussed deficiencies, it is a primary object to provide a cyclone dust collector which can prevent a suction force from being reduced and a vacuum cleaner having the same.

One or more exemplary embodiments also provide a cyclone dust collector which can easily remove foreign substances therein and a vacuum cleaner having the same.

According to an aspect of an exemplary embodiment, there is provided a vacuum cleaner including a cyclone dust collector, wherein the cyclone dust collector includes: a cyclone chamber including an inlet through which air is drawn in and an outlet through which dust-filtered air is discharged; a discharge passage disposed inside the cyclone chamber; a spiral part formed around the discharge passage to be inclined in a spiral pattern; and a grill rotatably disposed on the discharge passage, and wherein the outlet is formed inside the discharge passage.

The inlet and the outlet may be formed on a bottom surface of the cyclone chamber.

The discharge passage may form a discharge space therein to fluidly communicate with the outlet, and the cyclone dust collector may further include a fan that is rotatably disposed in the discharge space.

The grill may be mounted on the fan and rotated with the fan.

The grill may be rotated by a suction force of air that is provided to flow into the outlet.

The grill may be rotated by a driving force of a driving member connected to the fan to drive the fan.

The fan may include: a first fan which is rotated to make air flow into the outlet; and a second fan which generates an air current for interfering with an air current generated by the first fan.

The fan may further include a fan case which is connected to the outside of the first fan to accommodate the first fan, and the second fan may be connected to the outer surface of the fan case.

The fan may include: a rotary shaft which is connected to the fan and rotated with the fan; and a rotary shaft mounting part in which the rotary shaft is mounted, and the fan case may be spaced from the rotary shaft mounting part toward the outside.

The first fan and the second fan may intersect with each other.

The second fan may include: a straight line part of a straight line shape that is formed to be inclined downwardly by a predetermined angle; and a curved part connected to a lower end of the straight line part and formed to be inclined upwardly from the lower end of the straight line part.

The first fan may have a predetermined slope and a contact area of the first fan with drawn-in air is changed by adjusting the predetermined slope, such that a rotation speed of the fan is controlled.

The cyclone dust collector may further include a grill case that is rotatably accommodated in the fan.

The grill may include a protrusion protruding upwardly from a center thereof to be higher than a side surface of the grill.

The discharge passage may protrude from a bottom surface of the cyclone chamber and may include a discharge space which fluidly communicates with the outlet.

The cyclone chamber may have an inner surface having a cylindrical shape to form a whirling current of drawn-in air, and the discharge passage may include an outer surface having a shape corresponding to the inner surface of the cyclone chamber to guide the whirling current of the drawn-in air.

The first fan may be connected to the inside of the fan case in a radial direction from the rotary shaft, and the second fan may be formed along a circumference of the fan case at predetermined intervals.

According to an aspect of another exemplary embodiment, there is provided a cyclone dust collector including: a cyclone chamber which draws in air through an inlet formed on a lower portion thereof; a spiral part which is disposed inside the cyclone chamber to provide a whirling current to air drawn in through the inlet; a discharge passage which discharges air from which foreign substances are separated by the whirling current through an outlet formed on a lower portion; and a grill which filters foreign substances in air moving via the discharge passage, and is rotatably disposed on the discharge passage.

The grill may be mounted on a fan which is rotated by a rotation force and is rotated with the fan.

The fan may include a first fan which extends from the center of the fan to the outside to allow the fan to be rotated by a suction force in one direction; and a second fan which is disposed outside the first fan to form an air current in a direction opposite to that of a current generated by the suction force.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
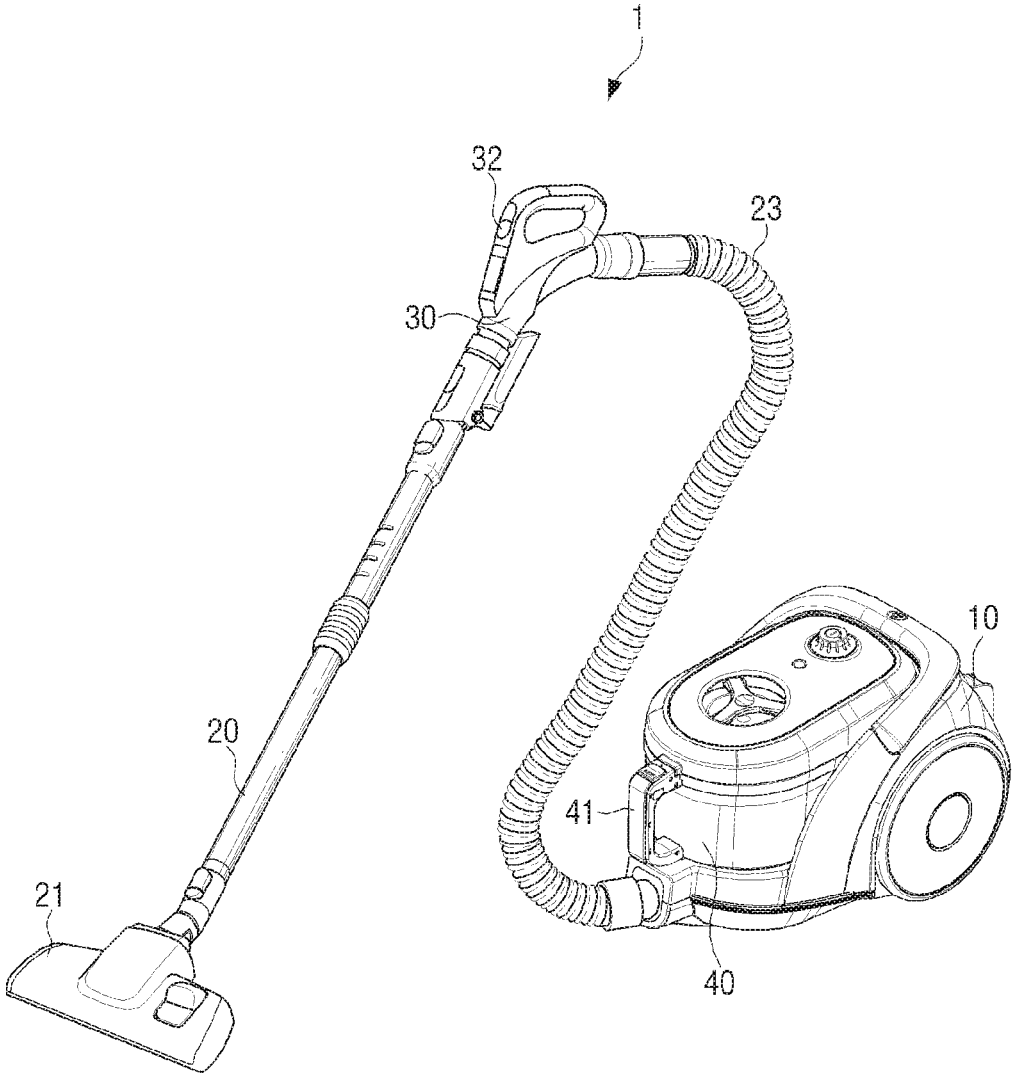
FIG. 1 illustrates a view of a vacuum cleaner according to various embodiments of the present disclosure.

FIGS. 1 through 19, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device.

Accordingly, various changes can be made to the embodiments described below within the scope of the present disclosure, and it will be understood that the variations in the embodiments belong to the technical scope of the present disclosure. Herein, in the drawings attached hereto to assist understanding of the embodiments, relevant elements from among the elements performing the same operations in each embodiment are given the same or similar reference numerals.

Figure 2:
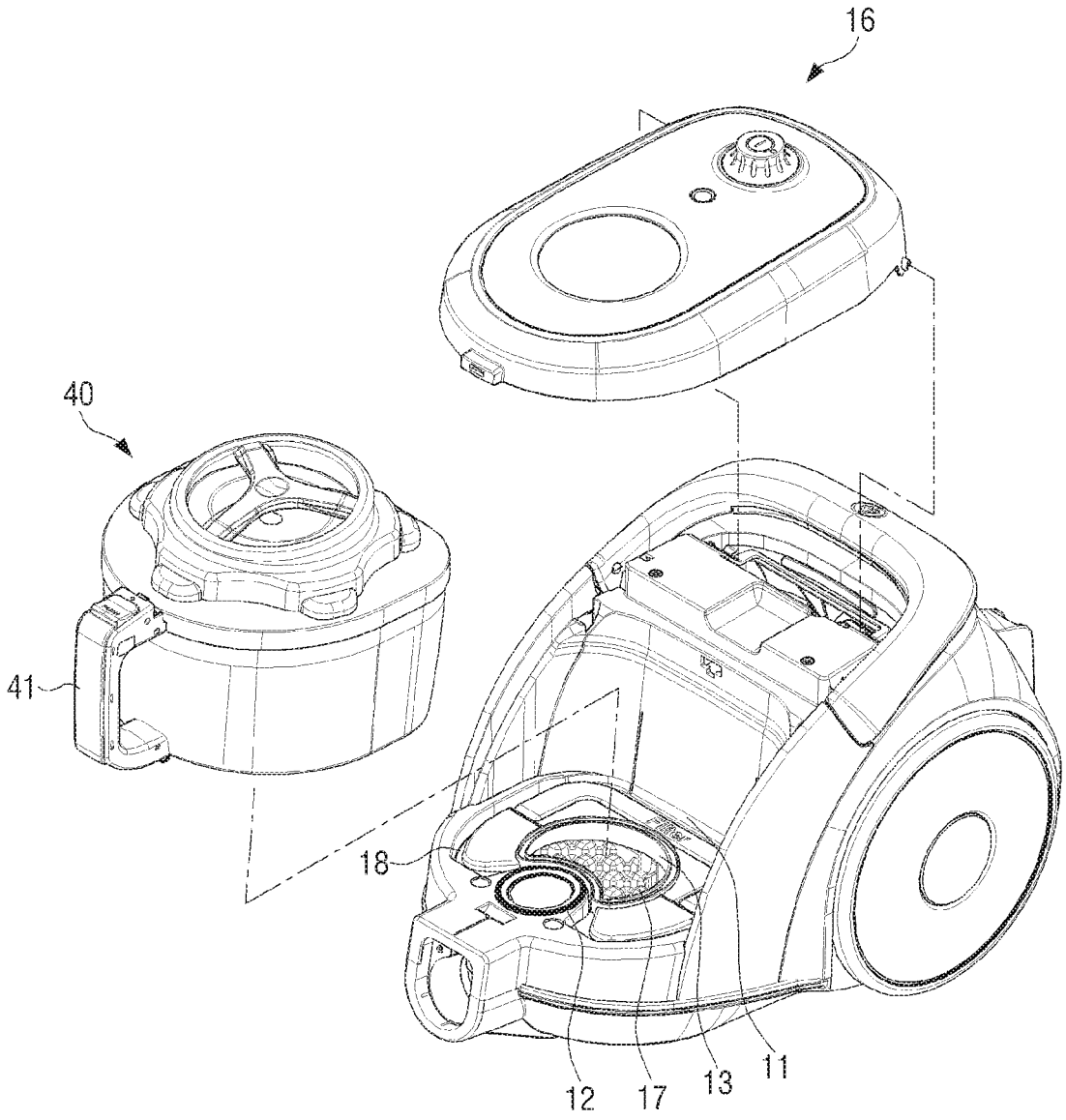
FIG. 2 illustrates a view of a cyclone dust collector and a main body that are separated from each other according to various embodiments of the present disclosure.

FIG. 1 illustrates a view of a vacuum cleaner according to various embodiments of the present disclosure, and FIG. 2 illustrates a view of a cyclone dust collector and a main body that are separated from each other according to various embodiments of the present disclosure.

Referring to FIGS. 1 and 2, the vacuum cleaner 1 according to an exemplary embodiment may be a canister type vacuum cleaner 1. Hereinafter, the canister type vacuum cleaner 1 will be described by way of an example, but the cyclone dust collector 40 may be widely used in an upright type cleaner, a handhold cleaner, or the like in addition to the canister type vacuum cleaner 1.

The vacuum cleaner 1 may include a main body 10, the cyclone dust collector 40 mounted in the main body 10, and a suction part 21 for drawing in air in contact with a cleaning surface. The cyclone dust collector 40 may generate a whirling current and separate air and foreign substances (for example, dust, hair, or the like) from each other using a centrifugal force.

The main body 10 may include a fan motor (not shown) to generate a suction force. The suction part 21 may draw in air and foreign substances contained in the art from the cleaning surface using the suction force generated in the main body 10. The suction part 21 may be formed in a wide and flat shape to be in close contact with the cleaning surface.

An extension pipe 20 made of resin or metal, a handle pipe 30 for user's manipulation, and a flexible hose 23 made of flexible material for freely moving the handle pipe 30 may be provided between the main body 10 and the suction part 21. An operation part 32 may be provided on the handle pipe 30 to operate the functions of the vacuum cleaner 1.

The suction part 21, the extension pipe 20, the handle pipe 30, and the flexible hose 23 may be provided to fluidly communicate with one another. Accordingly, the air drawn in through the suction part 21 may move to the main body by passing through these parts in sequence.

A suction port 12 for guiding drawn-in air into the cyclone dust collector 40 and a discharge port 13 for discharging cleaned air from the cyclone dust collector 40 may be provided in the main body 10. The discharge port 13 may fluidly communicate with a fan motor chamber (not shown) where the fan motor is provided.

The main body 10 is provided with a mounting part 11 for mounting the cyclone dust collector 40 therein, and the cyclone dust collector 40 may be removably mounted in the mounting part 11. The cyclone dust collector 40 is configured to remove foreign substances from air drawn-in through the suction port 12 and collect the foreign substance, and discharge the cleaned air through the discharge port 13.

The main body 10 may be provided with a micro filter 17 for filtering fine dust from the air discharged through the discharge port 13 again, and a filter mounting part 18 for mounting the micro filter 17. The micro filter 17 may be a sponge. The micro filter 17 may be removably mounted in the filter mounting part 18. The filter mounting part 18 may be provided to be opened and closed by detaching or attaching a cyclone chamber 53.

For example, in response to a need to clean or replace the micro filter 17, the cyclone chamber 53 may be removed from the main body 10 and the micro filter 17 may be removed from the filter mounting part 18.

The main body 10 may further include an external cover 16 for covering the upper portion of the cyclone dust collector 40 being mounted in the mounting part 11. The external cover 16 may have one side rotatably connected to the main body 10 and the other side attachably and detachably connected to a handler 41 provided on the cyclone dust collector 40.

The cyclone dust collector 40 includes an inlet 43 (see FIG. 4) through which air containing foreign substances flows in, and an outlet 44 (see FIG. 4) through which cleaned air is discharged. In response to the cyclone dust collector 40 being mounted in the main body 10, the inlet 43 (see FIG. 4) of the cyclone dust collector 40 may fluidly communicate with the suction port 12 of the main body 10, and the outlet 44 (see FIG. 4) of the cyclone dust collector 40 may fluidly communicate with the discharge port 13 of the main body 10.

Figure 3:
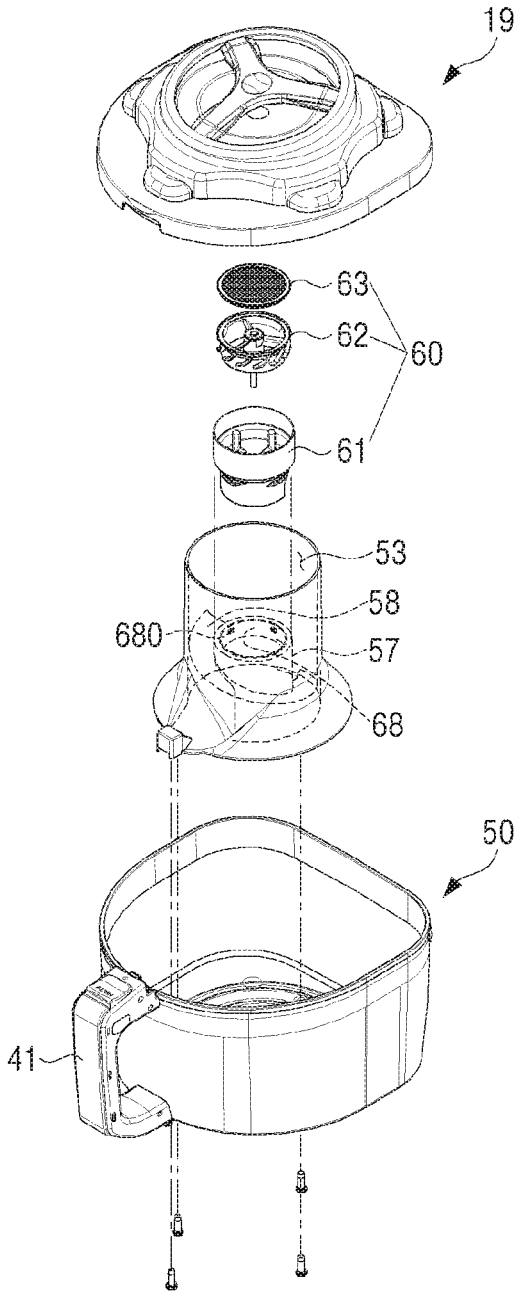
FIG. 3 illustrates an exploded perspective view of the cyclone dust collector according to various embodiments of the present disclosure.
Figure 4:
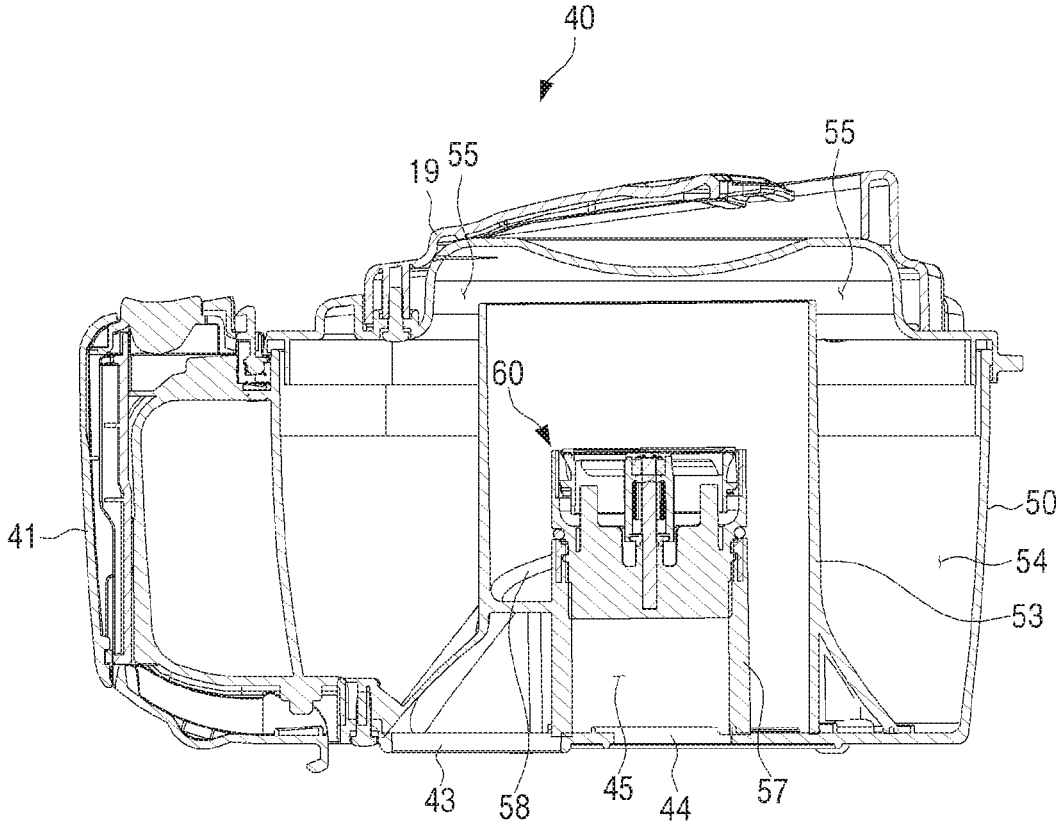
FIG. 4 illustrates a cross section view of the cyclone dust collector according to various embodiments of the present disclosure.

FIG. 3 illustrates an exploded perspective view of the cyclone dust collector according to various embodiments of the present disclosure, and FIG. 4 illustrates a cross section view of the cyclone dust collector according to various embodiments of the present disclosure.

Referring to FIGS. 3 and 4, the cyclone dust collector 40 according to an exemplary embodiment may include a case 50 having a top surface opened, and the upper cover 19 provided on the upper portion of the case 50. The case 50 may have the inlet 43 formed on bottom surface thereof to fluidly communicate with the suction port 12 of the main body 10, and the outlet 44 fluidly communicate with the discharge port 13 of the main body 10.

The inlet 43 and the outlet 44 may be formed on the bottom surface of the case 50 and spaced from each other, and may be disposed in the cyclone chamber 53. Alternatively, the inlet 43 and the outlet 44 may be integrally formed with each other to fluidly communicate with each other, or may be partitioned from each other by a discharge passage 57, which will be described, and separately provided.

The cyclone chamber 53 may be provided in the case 50 to generate a whirling current and to separate foreign substances using a centrifugal force. The cyclone chamber 53 may be formed in a substantially cylindrical shape to make air, drawn-in through the inlet 43, whirl upwardly and make it easy to separate foreign substances from the drawn-in air.

The cyclone chamber 53 may be connected to the bottom surface of the case 50 to partition the inside of the case 50. The cyclone chamber 53 may be integrally formed with the case 50. The cyclone chamber 53 may be attachably and detachably connected to the case 50 by means of a fastening means.

The cyclone chamber 53 may form a space where the air drawn-in through the inlet 43 whirls upwardly, and a collection chamber 54 may be partitioned between the cyclone chamber 53 and the case 50 to collect separated foreign substances from the inside of the cyclone chamber 53. Herein, the collection chamber 54 may be referred to as a collection space that is partitioned from the inside of the cyclone chamber 53.

The height of the cyclone chamber 53 may be the same as or higher than the height of the case 50, and the bottom surface of the upper cover 19 may be spaced from the upper end of the cyclone chamber 53 by a predetermined distance so as to form an opening 55 fluidly communicate with the cyclone chamber 53 and the collection chamber 54. The side surface of the upper cover 19 may be formed to be mounted on the circumference of the case 50, and the bottom surface of the upper cover 19 may protrude upwardly to have a curvature shape.

The upper cover 19 may include a protrusion (not shown) protruding from the bottom surface thereof downwardly. The protrusion may have a substantially cylindrical shape to correspond to the cyclone chamber 53, and may be disposed in the center of the cyclone chamber 53. The lower end of the protrusion may be lower than the upper end of the cyclone chamber 53, and foreign substances drawn-in through the inlet 43 with air may rotate while maintaining the whirling current due to the outer circumference of the cyclone chamber 53 and the outer circumference of the protrusion, and may be collected in the collection chamber 54.

The inlet 43 and the outlet 44 may be disposed inside the cyclone chamber 53. The cyclone chamber 53 may be disposed in the center of the case 50. When the cyclone chamber 53 is disposed in the center of the case 50, the collected foreign substances may be evenly stacked inside the collection chamber 54, such that the cleaning period of the collection chamber 54 may be extended. The cyclone chamber 53 may be disposed to be eccentric so as to be close to one side surface of the inside of the case 50.

The cyclone dust collector 40 may have a lower exhaust structure that separates foreign substances by making air drawn-in through a lower portion whirl upwardly and discharges the cleaned air to the lower portion.

The cyclone dust collector 40 may be provided with the discharge passage 57 formed therein, and the discharge passage 57 may provide a discharge space 45 which fluidly communicates with the outlet 44. The discharge passage 57 may be disposed on the bottom surface in the cyclone chamber 53, or may be integrally formed with the cyclone chamber 53. The discharge passage 57 may be attachably and detachably connected with the cyclone chamber 53 by means of a separate fastening member.

The air flowing into the cyclone dust collector 40 is guided to the cyclone chamber 53 through the inlet 43. The air guided to the cyclone chamber 53 rises while whirling around the center of the discharge passage 57 due to a spiral part 58 disposed between the cyclone chamber 53 and the discharge passage 57.

Foreign substances heavier than air may be scattered outwardly in a radial direction by a centrifugal force, and may flow into the collection chamber 54 through the opening 55 formed between the cyclone chamber 53 and the upper cover 19. The foreign substances flowing into the collection chamber 54 may fall down by gravity and may be collected in the collection chamber 54.

The discharge passage 57 may be formed in a cylindrical shape to have the discharge space 45, and the discharge space 45 and the outlet 44 fluidly communicate with each other, such that cleaned air is discharged through the outlet 44. A grill assembly 60 may be disposed on the discharge passage 57 to filter dust from air from which dust has been removed by the centrifugal force for the first time again. For example, the grill assembly 60 may be mounted on the upper end of the discharge passage 57.

The grill assembly 60 may include a grill 63 and a grill case 61 in which the grill 63 is rotatably mounted. The air from which the foreign substances are filtered by the grill 63 may be discharged to the outside from the cyclone dust collector 40 through the outlet 44. A detailed configuration of the grill assembly 60 will be described below.

As described above, in response to the fan motor (not shown) of the main body 10 being driven, air is drawn in from a cleaning surface through the suction part 21 by the suction force of the fan motor. The drawn-in air may pass through the extension pipe 20, the handle pipe 30, and the flexible hose 23 in sequence and flow into the cyclone dust collector 40 mounted in the main body 10.

The air flowing into the cyclone dust collector 40 may be guided to the cyclone chamber 53 through the inlet 43. The air guided to the cyclone chamber 53 rises while whirling upward around the discharge passage 57 due to the spiral part 58 disposed in the cyclone chamber 53.

The foreign substances heavier than air may be scattered outward in the radial direction by the centrifugal force, and flow into the collection chamber 54 through the opening 55 disposed on the upper portion of the cyclone chamber 53. The dust flowing into the collection chamber 54 may fall down by gravity and may be collected in the collection chamber 54.

The air from which dust has been filtered by the centrifugal force in the cyclone chamber 53 for the first time may be filtered to remove dust of a predetermined size or more by passing through the grill assembly 60. The air which passes through the grill assembly 60 may flow into the discharge passage 57 and the outlet 44 and may be guided to the lower side. The air guided to the discharge port 13 of the main body 10 through the outlet 44 may be filtered to remove fine dust by the micro filter 17 provided in the filter mounting part 18 for the third time. Finally, cleaned air may be discharged to the outside of the main body 10 via the fan motor chamber (not shown).

Figure 5:
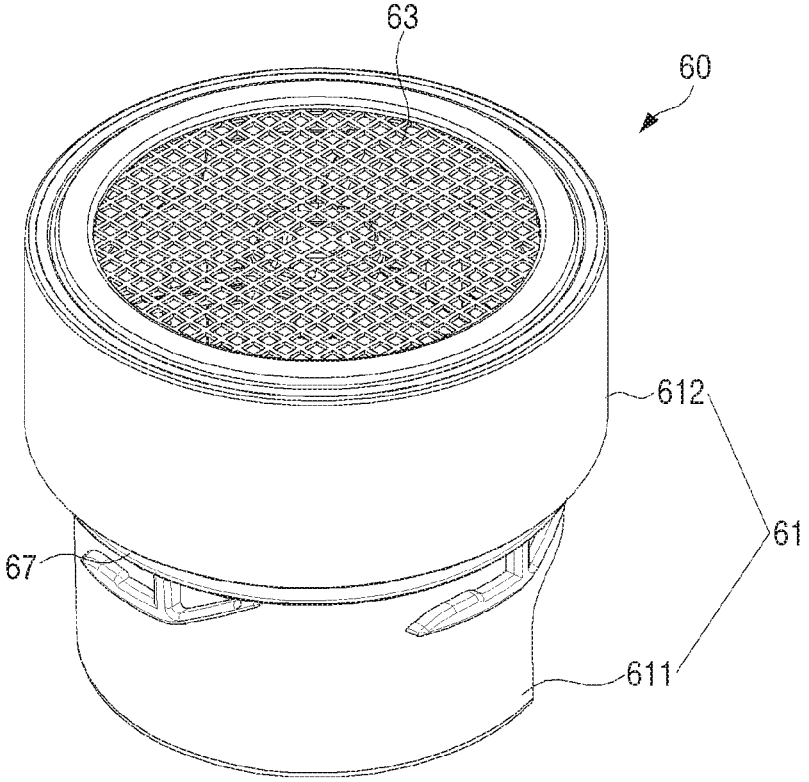
FIGS. 5 and 6 illustrate perspective views of a grill assembly according to various embodiments of the present disclosure.
Figure 6:
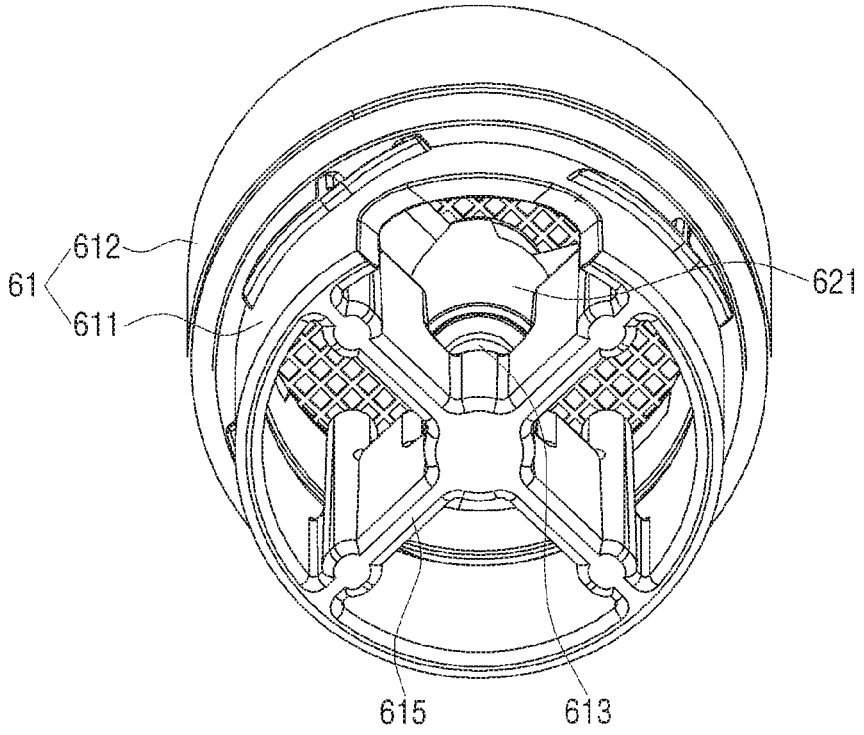
Figure 7:
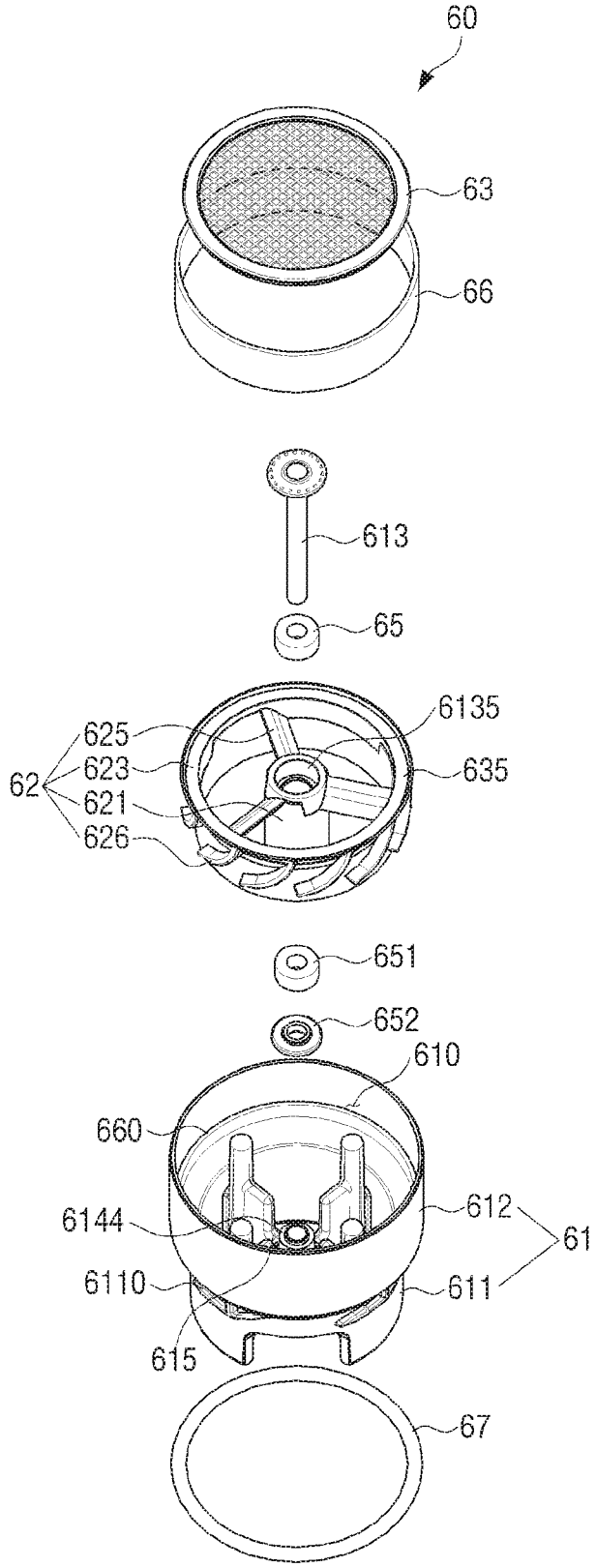
FIG. 7 illustrates an exploded perspective view of the grill assembly according to various embodiments of the present disclosure.
Figure 8:
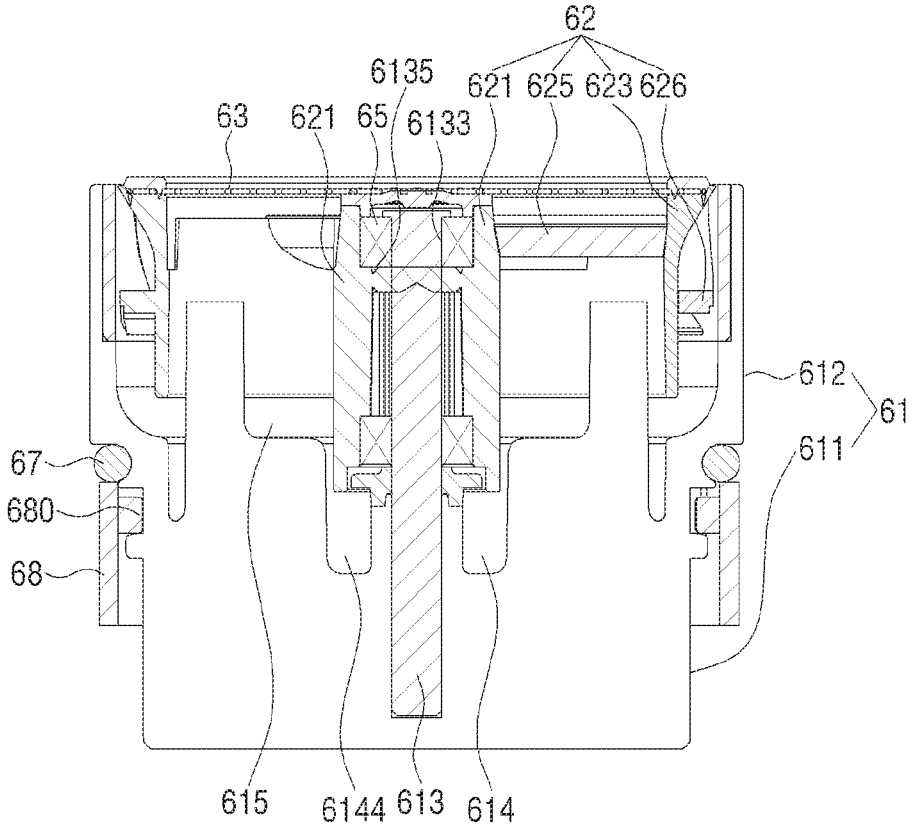
FIG. 8 illustrates a view of the operation of the grill assembly according to various embodiments of the present disclosure.

FIGS. 5 and 6 illustrate perspective views of the grill assembly according to various embodiments of the present disclosure, FIG. 7 illustrates an exploded perspective view of the grill assembly according to various embodiments of the present disclosure, and FIG. 8 illustrates a cross section view of the grill assembly according to various embodiments of the present disclosure.

Referring to FIGS. 5 to 8, the grill assembly 60 may include a fan 62 that is provided to be rotatable by the suction force of the fan motor (not shown), and the grill 63 that is mounted on the fan 62. The fan 62 may be rotatably mounted in the grill case 61. The grill 63 may be mounted on the fan 62 to rotate with the fan 62.

The grill case 61 may be mounted on the discharge passage 57. The grill case 61 may have a shape corresponding to the shape of the discharge passage 57. When the discharge passage 57 has a cylindrical shape, the grill case 61 may be formed in a substantially cylindrical shape. The grill case 61 may be removably mounted on the discharge passage 57, such that the grill assembly 60 can be cleaned or replaced.

The grill case 61 may be connected to the discharge passage 57 by means of a fastening member. The grill case 61 may be directly screwed to the discharge passage 57 by screw threads formed on the outer circumference of the grill case and the inner circumference of the discharge passage 57, or may be snap-fitted into the discharge passage 57 without a separate fastening member. The grill case 61 may be tight-fitted into the discharge passage 57. The method of connecting the grill case 61 and the discharge passage 57 is not limited to the above-described methods.

For example, one side of the grill case 61 may be connected to the discharge passage 57 and the fan 62 may be mounted on the other side of the grill case 61. The part connected with the discharge passage 57 may be referred to as a first grill case 611 and the part on which the fan 62 is mounted may be referred to as a second grill case 612. The second grill case 612 and the first grill case 612 may be provided with steps. The diameter of the second grill case 612 may be larger than the diameter of the first grill case 611.

The first grill case 611 may be inserted into the discharge passage 57. Accordingly, the outer diameter of the first grill case 611 may be the same as the inner diameter of the discharge passage 57 or may be a bit smaller than the inner diameter of the discharge passage 57.

For example, a support ring 68 may be disposed on the inner circumference of the discharge passage 57. The support ring 68 may have a supporting protrusion 680 protruding from the inner circumference thereof. A fitting protrusion 6110 may be formed on the outer circumference of the second grill case 612. The fitting protrusion 6110 may be inserted into a space where the supporting protrusion 680 is not disposed and may be rotated toward the supporting protrusion 680, such that the second grill case 612 is connected to the discharge passage 57. The supporting protrusion 680 may be integrally formed with the discharge passage 57 by injection molding to be disposed on the inner circumference of the discharge passage 57.

The grill assembly 60 may further include a sealing member 67. The sealing member 67 may be interposed between the discharge passage 57 and the second grill case 612 to connect them in a close contact state between the discharge passage 57 and the second grill case 612. The sealing member 67 may be made of elastic material such as robber, silicon, or the like. Accordingly, air that has not yet been filtered by the grill can be prevented from flowing into the discharge passage 57 via a space between the second grill case 612 and the discharge passage 57.

For example, the second grill case 612 may be provided with a seating part 69 formed therein with a step, and a guide ring 66 may be placed on the seating part 660 and supported by the seating part 660. The guide ring 66 can ensure the roundness of the grill case. In addition, the guide ring 66 can reduce a clearance between the second grill case 612 and the fan 62 and thus can prevent foreign substances from flowing between the second grill case 612 and the fan 62. The guide ring 66 may be made of metal or material having high strength.

The diameter of the second grill case 612 may be the same as the diameter of the outer circumference of the discharge passage 57 or may be a bit larger than the diameter of the outer circumference of the discharge passage 57. The second grill case 612 may be provided with a fan receiver 610 that is a space for accommodating the fan 62. A rotary shaft 613 may be provided in the center of the fan receiver 610.

A fan mounting part 614 may be provided in the center of the fan receiver 610. The fan mounting part 614 may have a penetrating hole 6141 formed on the center thereof, and a seating recess 6144 for having a body 621 seated therein. The fan mounting part 614 may be disposed in the center of the second grill case 612 and a plurality of supporting ribs 615 may extend toward the center and connect the fan mounting part 614 to the grill case 61.

The fan 62 may be rotatably mounted on the center of the fan mounting part 614, and may be rotatably mounted on the rotary shaft 613. The penetrating hole 6141 may penetrate through the fan mounting part 614 and the rotary shaft 613 may be inserted into the penetrating hole 6141 and supported thereby to be rotatable.

The fan 62 may be connected to the outside of the rotary shaft 613 to rotate with the rotary shaft 613. The fan 62 may include the body 621 having an insertion hole 6133 formed therein in a longitudinal direction to allow the rotary shaft 613 to be inserted therethrough, a fan case 623 formed on the outer circumference of the body 621, and a first fan 625 formed between the fan case 623 and the body 621 and a second fan 626 formed on the outer circumference of the fan case 623.

The body 621 may have the insertion hole 6133 into which the rotary shaft 613 is inserted, and the rotary shaft 613 may be connected with the grill case 61 through the fan mounting part 614. A bearing 65, 651 may be interposed between the rotary shaft 613 and the body 621 to prevent the rotation of the fan 62 from being limited by a friction generated between the rotary shaft 613 and the inner surface of the body 621. A bearing mounting part 6135 may be formed on the body 621, and a plurality of bearings 65, 651 may be formed on the circumference of the rotary shaft 613, being spaced from each other in a vertical direction.

The rotary shaft 613 may be inserted into the insertion hole 6133 of the body 621 and the penetrating hole 6141 of the fan mounting part 614, and the body 621 may be supported in the seating recess 6144. That is, the fan 62 may be stably supported in the fan mounting part 614, and the rotary shaft 613 having the bearing 65, 651 mounted thereon may be inserted into the fan mounting part 614, such that the fan 62 is mounted in the grill case 61 to be rotatable about the rotary shaft 613. In this case, the grill assembly 60 may further include a connection ring 652 to support the bearing 651 disposed on the lower portion on the body 621.

The fan case 623 may be formed around the body 621 in an annular shape. A grill mounting part 635 may be formed on the top surface of the fan case 623, and the grill 63 may be fixed to the grill mounting part 635 to rotate with the fan case 623. The first fan 625 may be connected to the body 621 and the fan case 623. In response to a suction force being generated by the fan motor, the fan 62 may be rotated by the first fan 625 in one direction. The moving direction of air by the rotation of the first fan 625 may be formed so as not to interfere with the movement of air generated by the suction force of the fan motor.

The second fan 626 may be formed on the outer circumference of the fan case 623. The second fan 626 may be installed to interfere with the movement of the air generated by the fan motor in a sucking direction. For example, the second fan 626 may be formed to move air in a different direction from the moving direction of the air provided by the first fan 625.

In response to a suction force being generated by the fan motor, the second fan 626 may move air from the upper end of the discharge passage 57 toward the outlet 44. That is, the second fan 626 may generate an air current in the opposite direction to the direction of the air current generated by the suction force of the fan motor. A plurality of second fans 626 may be formed on the outer circumference of the fan case 623 at regular intervals. Since the second fan 626 is formed on the side surface of the fan case 623, the second fan 626 may be called a side surface fan, and the first fan 625 formed inside the fan case 623 may be called an inner side fan.

The first fan 625, the second fan 626, the fan mounting part 614, the supporting ribs 615, and the fitting protrusion 6110 may be integrally formed with one another by injection molding. The grill 63 may be inserted at the time when the first fan 625, the second fan 626, the fan mounting part 614, the supporting ribs 615, and the fitting protrusion 6110 are formed by injection molding, and may be integrally formed therewith. The grill 63 may be bonded to the grill mounting part 635 by means of a bonding means after the first fan 625, the second fan 626, the fan mounting part 614, the supporting ribs 615, and the fitting protrusion 6110 are formed by injection molding. The method for mounting the grill 63 in the fan 62 is not limited to the above-described methods.

Figure 9:
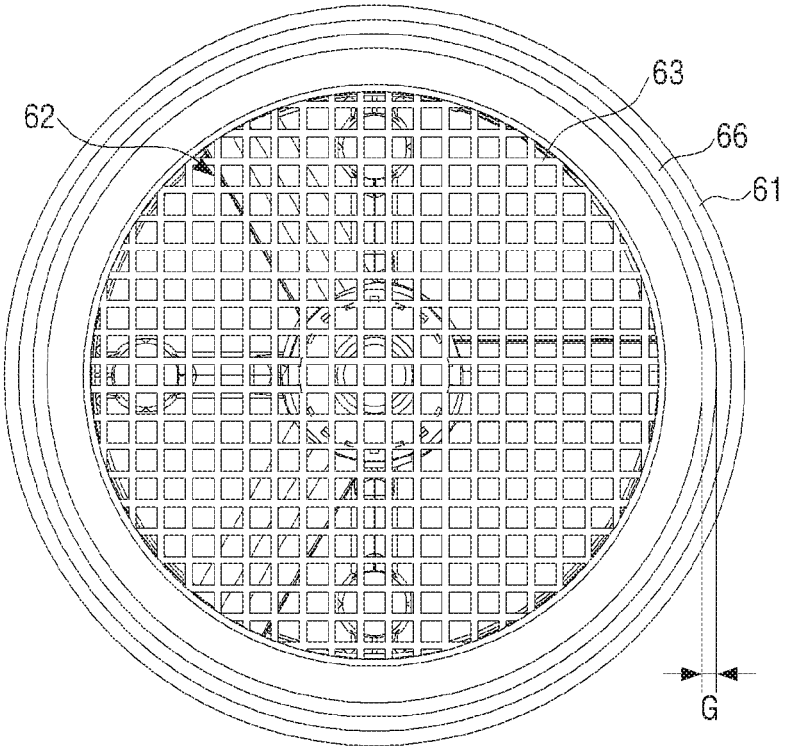
FIG. 9 illustrates a plane view of the grill assembly according to various embodiments of the present disclosure.
Figure 10:
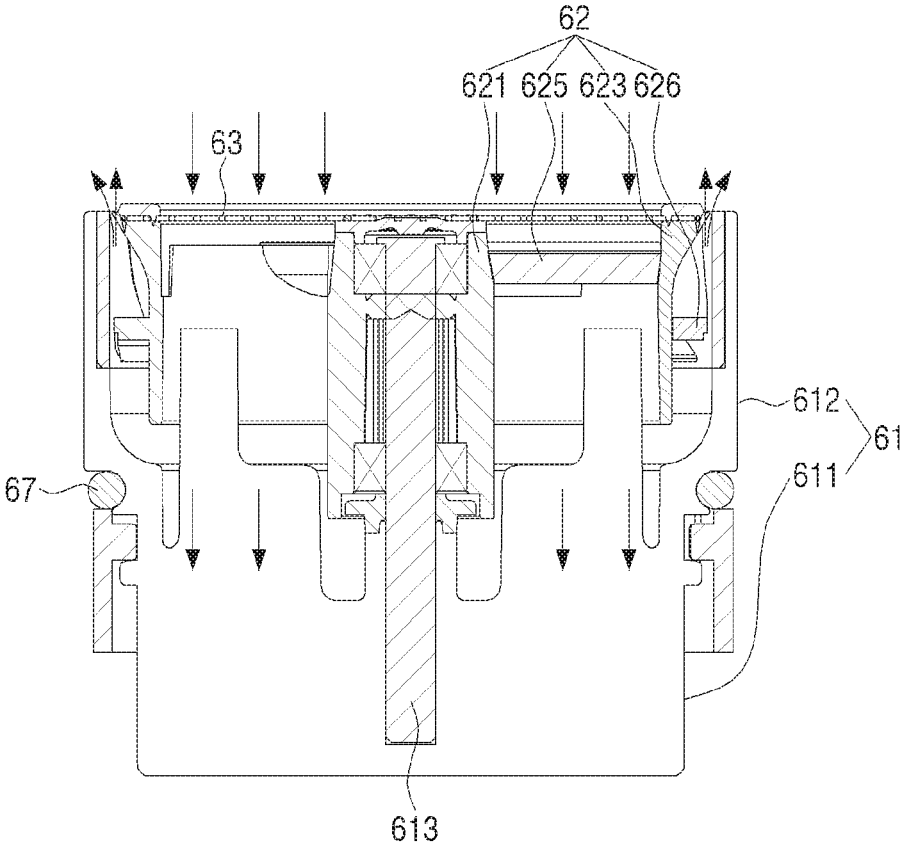
FIG. 10 illustrates a view of an example of the operation of the grill assembly according to various embodiments of the present disclosure.

FIG. 9 illustrates a plane view of the grill assembly according to various embodiments of the present disclosure, and FIG. 10 illustrates a view of the operation of the grill assembly according to various embodiments of the present disclosure. Referring to FIGS. 9 and 10, the grill 63 according to an exemplary embodiment is provided to be rotatable with the fan 62, and the guide ring 66 is provided between the inner surface of the grill case 61 and the outer surface of the fan 62. A predetermined gap (G) may be formed between the inner surface of the grill case 61 and the outer circumference of the fan case 623 so as to allow the fan 62 and the grill 63 to be rotated together.

In response to a suction force being generated by the fan motor, air that does not pass through the grill 63 may flow into the discharge passage 57 via the gap (G) between the inner surface of the grill case 61 and the outer circumference of the fan case 623. The air from which dusts are not filtered by the grill 63 may flow into the discharge passage 57 via the gap (G) and pass through the micro filter 17 via the outlet 44.

Since the air passing through the gap (G) is not filtered by the grill 63, the air may contain more dust than the air passing through the grill 63. Since more dust is filtered by the micro filter 17, the cleaning or replacement period of the micro filter 17 may be shortened.

In response to the micro filter 17 not being replaced or cleaned at the right time, air may not smoothly move and the suction force of the fan motor may be reduced. In response to the gap (G) being clogged by dust, hair, or like contained in the air, the grill 63 may not be rotated.

Accordingly, in order to prevent air from leaking through the gap (G), the second fan 626 formed on the outer surface of the fan case 623 may serve to interfere with the movement of air generated by the fan motor. Since air moving from the discharge passage 57 in a direction toward the upper cover 19 is generated by the second fan 626 in the gap (G) between the fan case 623 and the inner surface of the grill case 61, air can be prevented from leaking into the discharge passage 57 via the gap (G).

Accordingly, air that is not filtered by the grill 63 can be prevented from flowing into the discharge passage 57 in advance. In addition, the gap (G) can be prevented from being clogged by dust, hair, or the like and the rotation of the grill 63 can be prevented from being stopped.

According to an exemplary embodiment, the grill assembly 60 is provided to be rotatable with the grill 63 and dust on the surface of the grill 63 may fall away due to the centrifugal force. In response to a suction force being generated by the fan motor, the fan 62 and the grill 63 may be integrally rotated. The air that is filtered by the whirling current of the cyclone chamber 53 passes through the grill 63 and moves to the outlet 44 through the inside of the discharge passage 57.

In this case, since the air current is generated in the opposite direction to the direction of the air current generated by the suction force of the fan motor, in order to interfere with the movement of the air generated by the suction force of the fan motor in the gap (G) between the fan case 623 and the grill case 61, the air may not leak into the discharge passage 57 via the gap (G). The air in the cyclone chamber 53 may not leak into the discharge passage 57 via the gap (G) and only the air passing through the grill 63 may flow into the discharge passage 57.

Dust that does not pass through the air passing holes formed on the grill 63 may be rotated by the whirling current of the cyclone chamber 53 and collected in the collection chamber 54. According to an exemplary embodiment, the grill 63 is provided to be rotatable and dust, hair, or the like reaching the surface of the grill 63 may fall away from the grill 63 by the centrifugal force generated by the rotation of the grill 63. The dust falling away by the centrifugal force generated by the rotation of the grill 63 may be rotated by the whirling current of the cyclone chamber 53 and collected in the collection chamber 54.

Since the grill 63 is provided to be rotatable as described above, the suction force of the vacuum cleaner 1 can be prevented from being reduced and cleaning efficiency can be enhanced. The user is not required to directly remove dust and foreign substances attached to the surface of the grill 63 with user's hand. Since the user has only to remove the cyclone dust collector 40 from the main body 10 and bin only the foreign substances collected in the collection chamber 54, the cyclone dust collector 40 can be easily cleaned.

In addition, the air that is not filtered by the grill 63 can be prevented from flowing into the micro filter 17 by preventing dust from flowing into the discharge passage 57 via the gap (G) between the fan case 623 and the grill case 61. Accordingly, the cleaning or replacement period of the micro filter 17 can be extended in comparison to a related-art cleaner.

Figure 11:
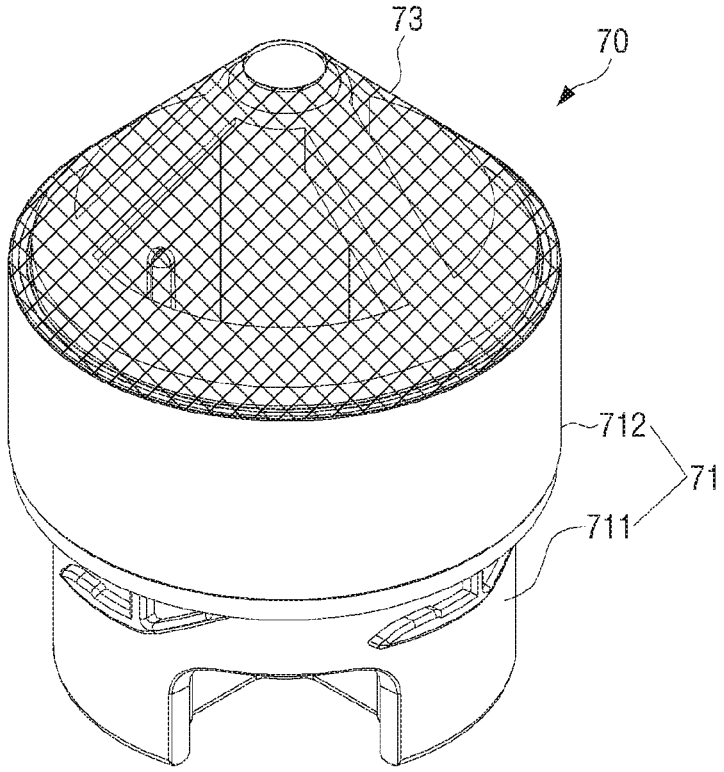
FIG. 11 illustrates a perspective view of another example of the grill assembly according to various embodiment of the present disclosure.
Figure 12:
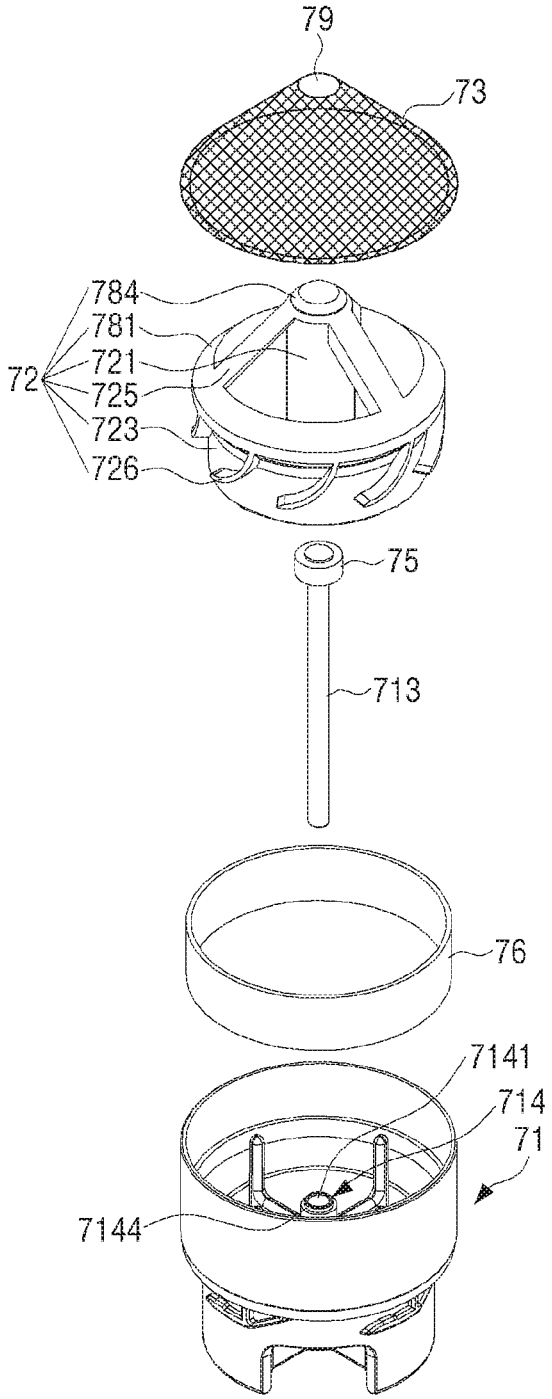
FIG. 12 illustrates a perspective view of another example of the grill assembly according to various embodiment of the present disclosure.

FIG. 11 illustrates a perspective view of another example of the grill assembly according to various embodiment of the present disclosure, and FIG. 12 illustrates an exploded perspective view of another example of the grill assembly according to various embodiment of the present disclosure. Referring to FIGS. 11 and 12, a grill 73 may be formed in a conical shape. Hereinafter, a difference from the grill assembly 60 described above with reference to FIGS. 1 to 10 will be described for convenience of explanation, but an omitted description may be substituted with the description above.

Since the grill 73 is formed in the conical shape, the area of the grill through which air passes may be enlarged. Since the area of the grill through which the air of the cyclone chamber 53 passes is enlarged, the suction force of the fan motor can be prevented from being reduced.

The grill assembly 70 includes a grill case 71 having a rotary shaft 713 disposed therein and supported by a plurality of ribs, a fan 72 provided to be rotatable by the suction force of the fan motor in one direction, and a grill 73 mounted on one side of the fan 72.

The fan 72 may include a first fan 725 that extends from the center thereof to a fan case 723 so as to allow the fan 72 to be rotated by the suction force of the fan motor in one direction, and a second fan 726 which is formed on the outer surface of the fan case 723 to generate an air current for interfering with the air current generated by the suction force of the fan motor. The second fan 726 can prevent air from leaking into the discharge passage 57 via a gap formed between the outer surface of the fan case 723 and the inner surface of the grill case 71.

For example, a fan mounting part 714 may be formed in the center of a fan receiver 710. The fan mounting part 714 may have a penetrating hole 7141 formed on the center thereof, and a seating recess 7144 for having a body 721 seated therein. The fan mounting part 714 may be disposed at the center of the grill case 71, and the plurality of supporting ribs may extend to the center to connect the fan mounting part 714 to the grill case 71.

The fan 72 may be rotatably mounted on the center of the fan mounting part 714, and may be rotatably mounted on the rotary shaft 713. The penetrating hole 7141 may penetrate through the fan mounting part 714, and the rotary shaft 713 may be inserted into the penetrating hole 7141 and supported thereby to be rotatable.

The fan 72 may be connected to the outside of the rotary shaft 713 to rotate with the rotary shaft 713. The fan 72 may include the body 721 having an insertion hole (not shown) formed therein in a longitudinal direction to allow the rotary shaft 713 to be inserted therethrough, the fan case 723 formed on the outer circumference of the body 721, and the first fan 725 formed between the fan case 723 and the body 721 and the second fan 726 formed on the outer circumference of the fan case 723.

The rotary shaft 713 may be connected with the grill case 71 through the fan mounting part 714. A bearing 75 may be interposed between the rotary shaft 713 and the body 721 to prevent the rotation of the fan 72 from being limited by a friction generated between the rotary shaft 713 and the inner surface of the body 721. A bearing mounting part may be formed on the body 721, and a plurality of bearings 75 may be formed on the circumference of the rotary shaft 713, being spaced from each other in a vertical direction.

The rotary shaft 713 may be inserted into the insertion hole of the body 721 and the penetrating hole 7141 of the fan mounting part 714, and the body 721 may be supported in the seating recess 7144. That is, the fan 72 may be stably supported in the fan mounting part 714, and the rotary shaft 713 having the bearing 75 mounted thereon may be inserted into the fan mounting part 714, such that the fan 72 can be rotated about the rotary shaft 613.

The fan case 723 may be formed around the body 721 in an annular shape. The body 721 may protrude upwardly from the fan case 723. A grill mounting part may be formed on the top surface of the fan case 723, and the grill 73 may be mounted on the upper outer surface (or grill mounting part) of the fan case 723 to rotate with the fan case 723.

The first fan 725 may be connected to the body 721 and the fan case 723. The first fan 725 that is mounted on the grill case 71 to be connected therewith, to the inner circumference of the connection ring 711, and to a supporting protrusion 714 formed on the upper end of the body 721. The first fan 725 may be inclined upwardly toward the supporting protrusion 784 in order to stably support the conical grill 73.

The first fan 725 may stably support the conical grill 73. The supporting protrusion 784 may protrude in a shape corresponding to a connection hole 79 formed on the upper end of the grill 73 to be inserted into and fixed to the connection hole 79. The first fan 725 and the supporting protrusion 784 may be formed to support the grill 73, such that the grill 73 cannot be shaken by the suction force of the fan motor and can be stably supported.

In response to a suction force being generated by the fan motor, the fan 72 may be rotated by the first fan 725 in one direction. The moving direction of air by the rotation of the first fan 725 may be formed so as not to interfere with the movement of air generated by the suction force of the fan motor.

The second fan 726 may be formed on the outer circumference of the fan case 723. The second fan 726 may be installed to interfere with the movement of the air by the first fan 725. For example, the second fan 726 may be formed to move air in a different direction from the moving direction of the air provided by the first fan 725.

The first fan 725 may be mounted on the fan case 723 and connected therewith or may be integrally formed with the fan case 723.

Figure 13:
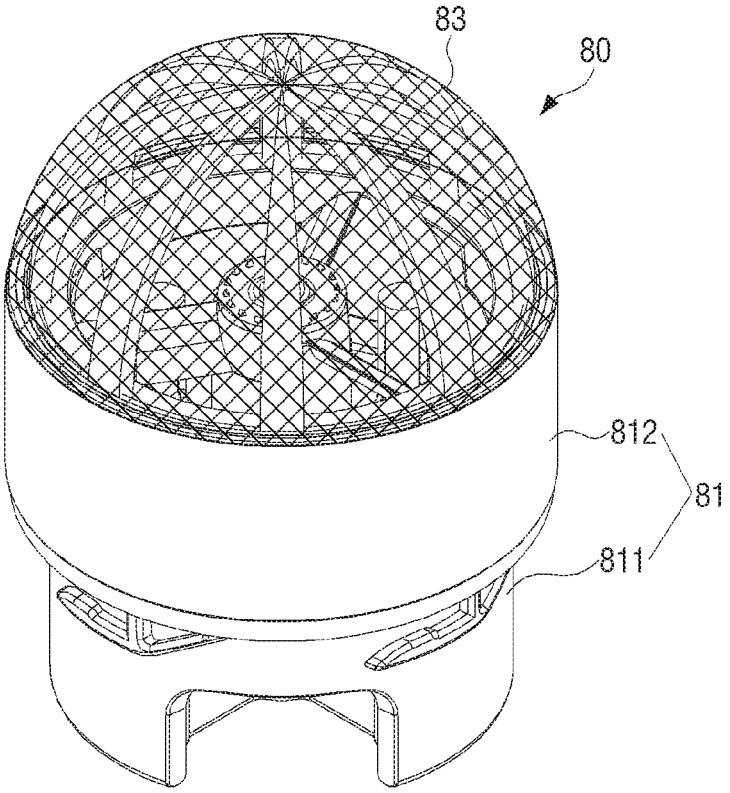
FIG. 13 illustrates a perspective view of still another example of the grill assembly according to various embodiment of the present disclosure.
Figure 14:
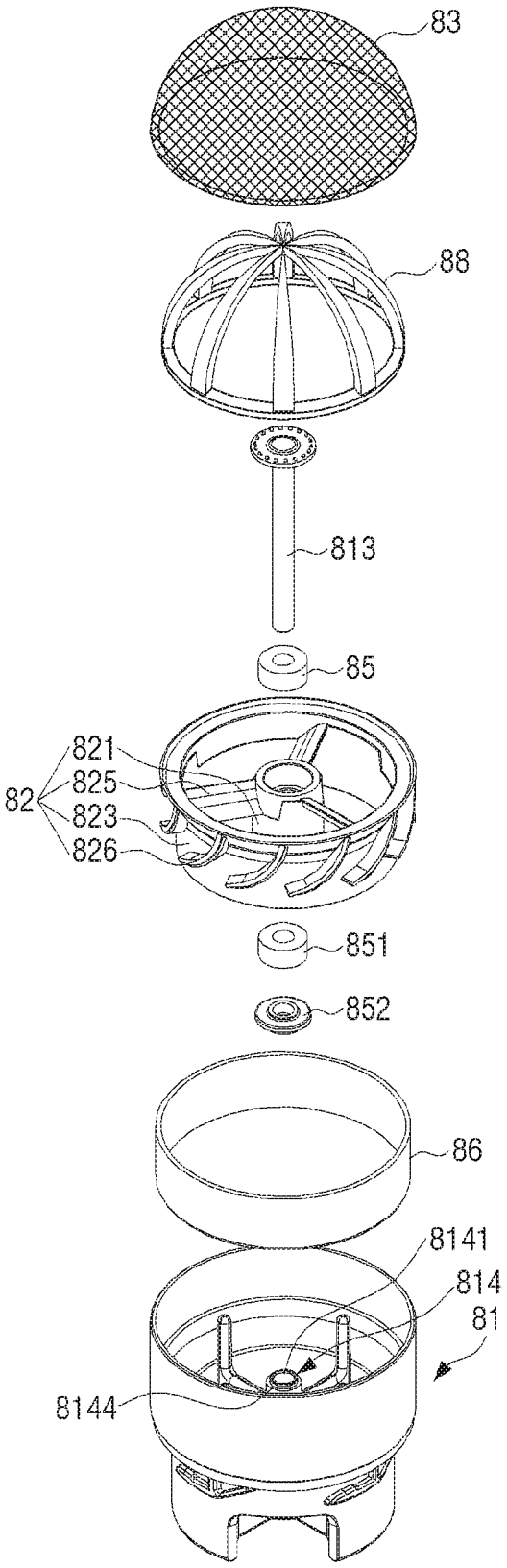
FIG. 14 illustrates a perspective view of still another example of the grill assembly according to various embodiment of the present disclosure.

FIG. 13 illustrates a perspective view of still another example of the grill assembly according to various embodiment of the present disclosure, and FIG. 14 illustrates an exploded perspective view of still another example of the grill assembly according to various embodiment of the present disclosure. Referring to FIGS. 13 and 14, a grill may be formed in a semi-spherical shape, and thus the area of the grill 83 through which air passes may be enlarged. Since the area of the grill 83 through which the air of the cyclone chamber 53 passes is enlarged, the suction force of the fan motor can be prevented from being reduced.

The grill assembly 80 includes a grill case 81 having a rotary shaft 813 disposed therein and supported by a plurality of ribs (not shown), a fan 82 provided to be rotatable by the suction force of the fan motor in one direction, and a grill 83 mounted on one side of the fan 82.

The fan 82 may include a first fan 825 that extends from the center thereof to a fan case 823 so as to allow the fan 82 to be rotated by the suction force of the fan motor in one direction, and a second fan 826 that is formed on the outer surface of the fan case 823 to generate an air current for interfering with the air current generated by the suction force of the fan motor. The second fan 826 can prevent air from leaking into the discharge passage 57 via a gap formed between the outer surface of the fan case 823 and the inner surface of the grill case 81.

The grill assembly may further include a supporting member 88 to stably support the hemi-spherical grill 83. The supporting member 88 may include a plurality of members formed along the circumference of the fan case at predetermined intervals so as to support the bottom surface of the hemi-spherical grill 83. The supporting member 88 is provided to support the grill 83, such that the grill 83 can be stably supported and rotated without being shaken by the suction force of the fan motor.

The shape of the grill 83 may be changed to various shapes in addition to the semi-spherical shape or conical shape described in the above-described embodiments. The grill 83 may have a center protruding upwardly to be higher than its side surface, and may have a shape to increase the area of the grill 83 through which air passes. Accordingly, as the area of the grill 83 through which the air of the cyclone chamber 53 passes is enlarged, the suction force of the fan motor can be prevented from being reduced.

Figure 15:
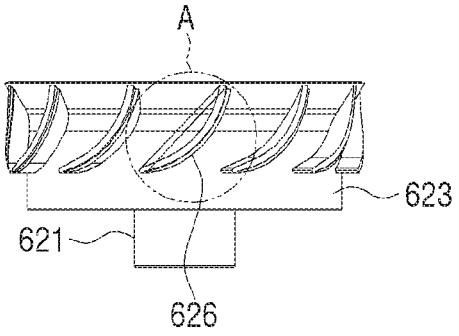
FIG. 15 illustrates a font view of a second fan according to various embodiments of the present disclosure.
Figures 16A, 16B, 16C:
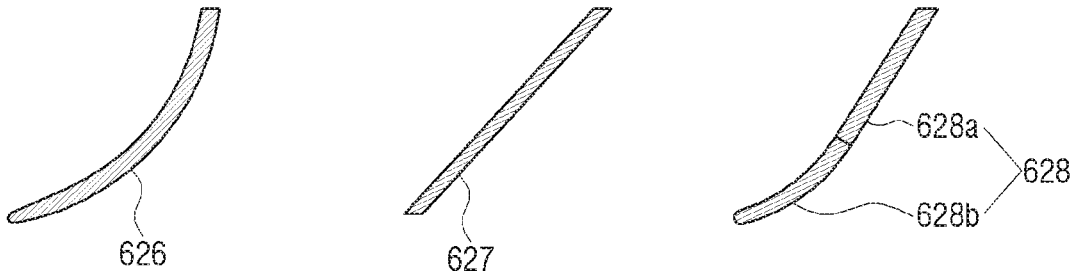
FIGS. 16A, 16B, and 16C illustrate views of other embodiments of the second fan according to various embodiment of the present disclosure.

FIG. 15 illustrates a front view of the second fan according to various embodiments of the present disclosure, and FIGS. 16A-16C illustrate other embodiments of the second fan. Referring to FIGS. 15 and 16A-16C, the second fan 626 is provided on the outer surface of the fan case 623 to generate an air current for interfering with the current generated by the suction force of the fan motor. The second fan 626 can prevent air from leaking into the discharge passage 57 via the gap formed between the outer surface of the fan case 623 and the inner surface of the grill case (not shown).

As shown in FIG. 16A, the second fan 626 may be inclined downwardly to have a substantially arc shape. The tilt angle of the second fan 626 may be formed to provide an air current of a different direction from that of the first fan 625 in consideration of the tilt angle, noise, and rotation speed of the first fan 625 or the like. For example, when the second fan 626 is disposed to intersect with the first fan 625, the second fan 626 may form the air current in the opposite direction to that of the air drawn in the discharge passage.

As shown in FIG. 16B, the second fan 627 may have a straight line shape. In addition, as shown in FIG. 16C, the second fan 628 may include a straight line part 628*a* that is inclined downwardly by a predetermined angle, and a curved part 628*b* that is connected to the lower end of the straight line part 628*a*. The curved part 628*b* is inclined upwardly from the lower end of the straight line part 628*a* to easily provide a rising air current.

Figure 17:
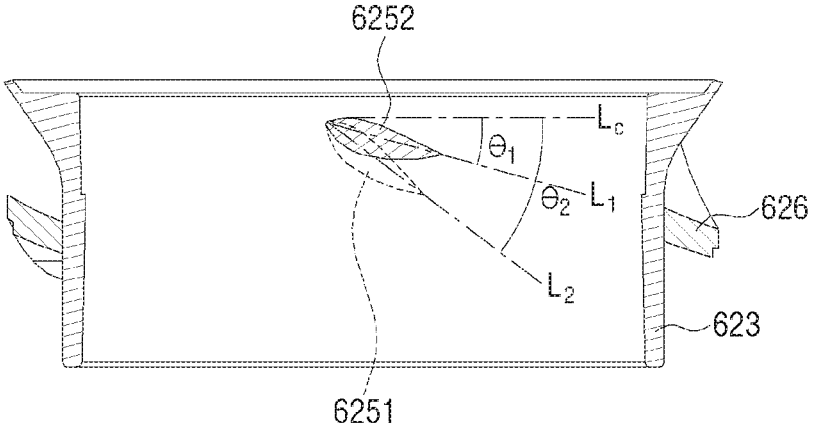
FIG. 17 illustrates a cross section view of an example of a change in a slope of a first fan according to various embodiments of the present disclosure.

FIG. 17 illustrates a cross section view of an example of a change in a slope of a first fan according to various embodiments of the present disclosure. Referring to FIG. 17, a first fan 6252 may have a first included angle (L1) between a virtual line (LC) that is tangent to the upper end of the first fan 6252 and a first center line (L1) passing through the center of the first fan 6252. Another first fan 6251 may have a second included angle (L2) between the virtual line (LC) tangent to the upper end of the first fan 6251 and a second center line (L2) passing through the center of the first fan 6251.

That is, the user may adjust a contact area between the first fan 6251, 6252 and air discharged by the suction force of the fan motor by changing the slope of the first fan 6251, 6252, and thereby may adjust a noise caused by the rotation of the fan, the rotation speed of the fan, or the like.

In addition, the user may change a title angle or a sweep angle of the fan by taking into account the number of rotations or a noise value caused by the rotation.

The noise generated in the fan may be divided into three types. There are a monopole noise source that generates a noise due to thickness of the fan, a dipole noise source which generates a noise due to a change in pressure of the fan surface, and a quadrupole noise source that generates a noise due to turbulence.

For example, in the case of a fan (or blade) swept in all directions, a pressure grade at a leading end is slow in comparison to a fan having no sweep and a grade in a rotation direction in a down-stream is reduced, and accordingly, a change in pressure due to the rotation of the blade is reduced and a grade in a turbulence kinetic energy rotation direction is reduced, such that a noise can be reduced.

In addition, the rotation speed of the fan can be adjusted by changing the tilt angle of the fan. In response to the contact area with moving air being increased by adjusting the slope of the fan, the rotation speed of the fan may increase. To the contrary, in response to the contact area of the fan with the moving air being reduced, the rotation speed of the fan may be reduced.

Figure 18:
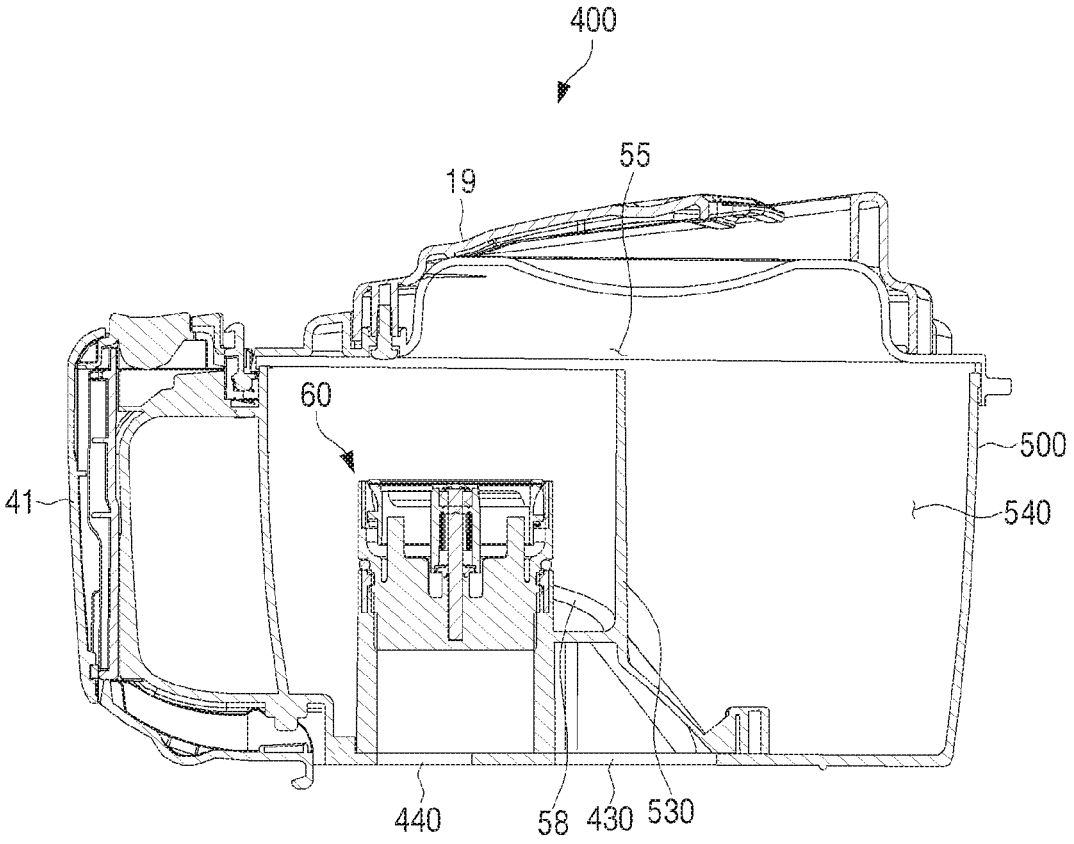
FIG. 18 illustrates a cross section view of a cyclone dust collector according to various embodiments of the present disclosure.

FIG. 18 illustrates a cross section view of a cyclone dust collector according to various embodiments of the present disclosure. Hereinafter, a difference from the cyclone dust collector according to the above-described embodiment will be described, but an omitted description may be substituted with the description above.

Referring to FIG. 18, the cyclone dust collector 400 according to another exemplary embodiment may have a cyclone chamber that is eccentrically disposed at one side thereof. The cyclone dust collector may include a case 500 having a top surface opened and an upper cover 19 formed on the upper portion of the case 500. Although not shown, an inlet 430 fluidly communicating with a suction port of a main body and an outlet 440 fluidly communicating with a discharge port of the main body may be formed on the bottom surface of the case 500.

The inlet 430 and the outlet 440 may be spaced from each other on the bottom surface of the case 500, and may be disposed in the cyclone chamber 530 Alternatively, the inlet 430 and the outlet 440 may be integrally formed with each other to fluidly communicate with each other or may be partitioned from each other by the discharge passage 57 and separately provided.

The case 500 may be provided with the cyclone chamber 530 formed therein to generate a whirling current and separate foreign substances using a centrifugal force. The cyclone chamber 530 may have a substantially cylindrical shape so as to make air, drawn-in through the inlet 430, whirl upwardly, and make it easy to separate foreign substances from the drawn-in air.

The cyclone chamber 530 may be connected to the bottom surface of the case 500 to partition the inside of the case 500. The cyclone chamber 530 may be integrally formed with the case 500. The cyclone chamber 530 may be attachably and detachably connected to the case 500 by means of a fastening member.

The cyclone chamber 530 may have a space formed therein to make the air, drawn-in through the inlet 430, whirl upwardly, and a collection chamber 540 may be formed between the cyclone chamber 530 and the case 500 to collect separated foreign substances from the inside of the cyclone chamber 530. The collection chamber 540 may be referred to as a collection space partitioned from the inside of the cyclone chamber 530.

Figure 19:
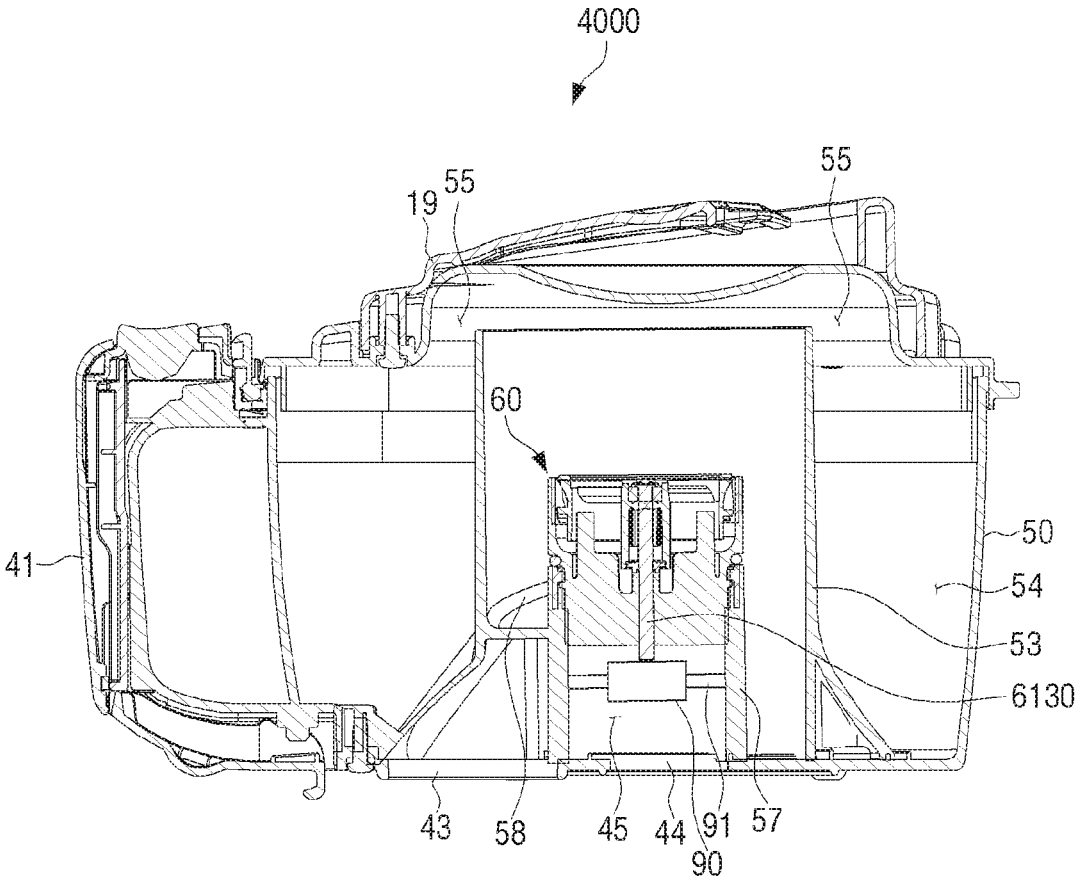
FIG. 19 illustrates a cross section view of a cyclone dust collector according to various embodiments or the present disclosure.

FIG. 19 illustrates a cross section view of a cyclone dust collector 4000 according to various embodiments of the present disclosure. Hereinafter, a difference from the cyclone dust collector according to the above-described embodiment will be described, but an omitted description may be substituted with the description above.

Referring to FIG. 19, a rotary shaft 6130 may extend to protrude downwardly, and a driving member 90 may be connected to the rotary shaft 6130 to rotate the rotary shaft 6130. The driving member 90 may be a driving motor and a driving means for rotating the rotary shaft 6130 is not limited to this.

The driving member 90 may be disposed in the discharge passage 57, and a driving member support frame 91 may be connected to the discharge passage 57 to support the driving member 90 against the discharge passage 57. Accordingly, the user can rotate the fan 62 using a separate driving means other than the suction force of the fan motor.

That is, when a separate driving means is used, the rotation speed of the fan can be uniformly maintained regardless of a suction mode (for example, a strong mode, a medium mode, a weak mode, or the like) or a dust suction state, and the performance of the grill assembly can be maintained.

The shape of the grill assembly and the structure of the cyclone dust collector described in the above-described embodiments are not limited to the above-described shape and structure. The grill may be provided to be rotated by the suction force of the fan motor or may be rotated by delivering a separate driving force to one of the elements of the grill assembly.

In addition, in the above-described embodiments, the first fan and the second fan are integrally formed with each other, but the first fan and the second fan may be separately prepared and mounted.

Since the grill is provided to be rotatable, dust or the like can be prevented from being attached to the surface of the grill by the centrifugal force. Accordingly, the suction force can be prevented from being reduced and thus cleaning efficiency can be prevented from deteriorating. In addition, since the user is not required to directly remove dust attached to the surface of the grill with user's hand, the cleaner is sanitary and has a convenience of using.

Although various exemplary embodiments have been described individually, each of the embodiments is not necessarily implemented alone and the configuration and operation of each embodiment may be implemented in combination with at least one other embodiment.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A vacuum cleaner comprising a cyclone dust collector, wherein the cyclone dust collector comprises:

a cyclone chamber including an inlet through which air is drawn in and an outlet through which dust-filtered air is discharged;

a discharge passage disposed inside the cyclone chamber;

a spiral part formed around the discharge passage to be inclined in a spiral pattern;

a fan rotatably disposed in the discharge passage; and a grille rotatably disposed on a planar surface of the discharge passage and air permeable, wherein the grille is mounted on the fan and configured to rotate with the fan, and wherein the outlet is formed inside the discharge passage.

2. The vacuum cleaner of claim 1, wherein the inlet and the outlet are formed on a bottom surface of the cyclone chamber.

3. The vacuum cleaner of claim 1, wherein the discharge passage is configured to form a discharge space therein to fluidly communicate with the outlet, and wherein the fan is rotatably disposed in the discharge space.

4. The vacuum cleaner of claim 1, wherein the grille is rotated by a suction force of air that is provided to flow into the outlet.

5. The vacuum cleaner of claim 1, wherein the grille is rotated by a driving force of a driving member connected to the fan to drive the fan.

6. The vacuum cleaner of claim 3, wherein the fan comprises:

a first fan configured to rotate to make air flow into the outlet; and a second fan configured to generate an air current for interfering with an air current generated by the first fan.

7. The vacuum cleaner of claim 6, wherein:

the fan further comprises a fan case connected to the outside of the first fan and configured to accommodate the first fan, and the second fan is connected to an outer surface of the fan case.

8. The vacuum cleaner of claim 7, wherein:

the fan comprises:

a rotary shaft connected to the fan and configured to rotate with the fan; and a rotary shaft mounting part in which the rotary shaft is mounted, the fan case is spaced from the rotary shaft mounting part toward the outside.

9. The vacuum cleaner of claim 6, wherein the first fan and the second fan intersect with each other.

10. The vacuum cleaner of claim 9, wherein the second fan comprises:

a straight line part of a straight line shape that is formed to be inclined downwardly by a predetermined angle; and a curved part connected to a lower end of the straight line part and formed to be inclined upwardly from the lower end of the straight line part.

11. The vacuum cleaner of claim 6, wherein the first fan has a predetermined slope and a contact area of the first fan with drawn-in air is changed by adjusting the predetermined slope, such that a rotation speed of the fan is controlled.

12. The vacuum cleaner of claim 3, wherein the cyclone dust collector further comprises a grille case in which the fan is rotatably accommodated.

13. The vacuum cleaner of claim 1, wherein the grille includes a protrusion protruding upwardly from a center thereof to be higher than a side surface of the grille.

14. The vacuum cleaner of claim 1, wherein the discharge passage is configured to protrude from a bottom surface of the cyclone chamber and includes a discharge space that fluidly communicates with the outlet.

15. The vacuum cleaner of claim 14, wherein:

the cyclone chamber has an inner surface having a cylindrical shape and configured to form a whirling current of drawn-in air, and the discharge passage includes an outer surface having a shape corresponding to the inner surface of the cyclone chamber to guide the whirling current of the drawn-in air.

16. The vacuum cleaner of claim 8, wherein:

the first fan is connected to the inside of the fan case in a radial direction from the rotary shaft, and the second fan is formed along a circumference of the fan case at predetermined intervals.

* * * * *